US010130142B2

(12) United States Patent
Meir

(10) Patent No.: US 10,130,142 B2
(45) Date of Patent: Nov. 20, 2018

(54) ARTICLE OF FOOTWEAR WITH KNITTED COMPONENT HAVING BIASED INTER-TOE MEMBER

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/058,252

(22) Filed: Mar. 2, 2016

(65) Prior Publication Data

US 2016/0302526 A1 Oct. 20, 2016

Related U.S. Application Data

(60) Provisional application No. 62/147,331, filed on Apr. 14, 2015.

(51) Int. Cl.
*A43B 23/00* (2006.01)
*A43B 23/02* (2006.01)
(Continued)

(52) U.S. Cl.
CPC ..... *A43B 23/0245* (2013.01); *A43B 1/04* (2013.01); *A43B 3/0036* (2013.01); *A43B 23/0265* (2013.01); *A43B 23/04* (2013.01)

(58) Field of Classification Search
CPC ..... A43B 1/04; A43B 3/0036; A43B 23/0245; A43B 23/0265; A43B 23/04; A43B 23/027; A41B 11/003; A41B 11/004; D04B 1/26
(Continued)

(56) References Cited

U.S. PATENT DOCUMENTS 2,675,631 A * 4/1954 Carr ..... A43B 1/04 36/12
3,013,564 A * 12/1961 Levey ..... A43B 7/26 2/240
(Continued)

FOREIGN PATENT DOCUMENTS

CN 101589864 A 12/2009
CN 101677635 A 3/2010
(Continued)

OTHER PUBLICATIONS

Office Action, and English language translation thereof, in corresponding Chinese Application No. 201610232518.7, dated Jul. 28, 2017, 16 pages.
(Continued)

*Primary Examiner* — Jameson Collier
*Assistant Examiner* — Heather Mangine
(74) *Attorney, Agent, or Firm* — Brinks Gilson & Lione

(57) ABSTRACT

An article of footwear includes a sole structure and an upper that is attached to the sole structure. The upper includes a forefoot region that is configured to receive a plurality of toes of a foot. The upper includes a first zone having a first elasticity, a second zone having a second elasticity, and a third zone having a third elasticity. The third zone is disposed between the first zone and the second zone. The third elasticity is greater than the first elasticity and the second elasticity. The third zone is configured to bias the first zone and the second zone toward each other. The third zone is biased generally toward the sole structure and configured to be received in a space located between two of the plurality of toes of the foot.

12 Claims, 8 Drawing Sheets

(51) Int. Cl.
*A43B 3/00* (2006.01)
*A43B 23/04* (2006.01)
*A43B 1/04* (2006.01)

(58) Field of Classification Search
USPC ..... 36/45, 94, 49; 66/178 R, 184, 185, 186
See application file for complete search history.

(56) References Cited

U.S. PATENT DOCUMENTS 5,913,592 A * 6/1999 Moore ..... A43B 7/26 36/4
6,151,804 A * 11/2000 Hieblinger ..... A43B 5/00 36/128
6,308,438 B1 * 10/2001 Throneburg ..... A43B 1/02 36/11
6,935,141 B2 * 8/2005 Takeda ..... A41B 11/00 66/187
7,059,156 B2 * 6/2006 Takeda ..... A41B 11/004 66/186
7,971,374 B2 * 7/2011 Hernandez ..... A43B 1/0081 36/129
2003/0074718 A1 * 4/2003 English ..... A41B 11/004 2/239
2005/0115284 A1 * 6/2005 Dua ..... A43B 1/04 66/178 R
2005/0166427 A1 * 8/2005 Greene ..... A43B 3/0026 36/128
2005/0282454 A1 12/2005 Meschter et al.
2007/0144039 A1 * 6/2007 Fliri ..... A43B 1/10 36/94
2008/0078102 A1 * 4/2008 Kilgore ..... A43B 5/00 36/50.1
2008/0110049 A1 * 5/2008 Sokolowski ..... A43B 1/04 36/50.1
2009/0276939 A1 * 11/2009 Sho ..... A41B 11/02 2/239
2009/0288451 A1 * 11/2009 Yokoyama ..... A41B 11/004 66/185
2011/0265252 A1 * 11/2011 Craig ..... A41B 11/01 2/239
2012/0017354 A1 * 1/2012 Vadnais ..... A41B 11/004 2/239
2012/0180195 A1 * 7/2012 Shull ..... A41B 11/003 2/239
2012/0233882 A1 9/2012 Huffa et al.
2013/0060182 A1 * 3/2013 Kotkamaa ..... A61F 5/019 602/30
2013/0205839 A1 * 8/2013 Fukui ..... D04B 1/02 66/185
2013/0212907 A1 8/2013 Dua et al.
2014/0053610 A1 * 2/2014 Fukui ..... D04B 1/102 66/183
2014/0150292 A1 * 6/2014 Podhajny ..... A43B 23/0205 36/50.1
2014/0173932 A1 6/2014 Bell
2014/0259760 A1 9/2014 Dojan et al.
2014/0317833 A1 * 10/2014 Craig ..... A41B 11/00 2/239
2014/0338226 A1 * 11/2014 Zavala ..... A43B 1/04 36/84
2015/0047225 A1 * 2/2015 Zavala ..... A43B 1/04 36/84
2015/0047227 A1 * 2/2015 Fallon ..... A43B 23/026 36/88
2015/0059210 A1 3/2015 Droege et al.
2015/0075031 A1 * 3/2015 Podhajny ..... A43B 1/04 36/45
2016/0017524 A1 * 1/2016 Nishino ..... D04B 1/26 28/153
2016/0174660 A1 * 6/2016 Iuchi ..... A43B 1/04 36/45
2016/0302526 A1 10/2016 Meir
2016/0302527 A1 * 10/2016 Meir ..... D04B 1/102
2017/0119083 A1 * 5/2017 Podhajny ..... A43B 1/04

FOREIGN PATENT DOCUMENTS

CN 202095634 U 1/2012
CN 203618866 U 6/2014
CN 205913005 U 2/2017
TW 201511703 A 4/2015
TW I478674 B 4/2015
TW M498500 U 4/2015

OTHER PUBLICATIONS

Office Action, and English language translation thereof, in corresponding Taiwan Application No. 105109901, dated Aug. 21, 2017, 17 pages.
Preliminary Report on Patentability and Written Opinion for Application No. PCT/US2016/021208, dated Oct. 17, 2017, 9 pages.
Second Office Action issued in Chinese Patent Application No. 2016102325187 dated Feb. 12, 2018 (9 pages) with English Translation (6 pages).
International Search Report and Written Opinion for corresponding PCT/US2016/021208, dated Jun. 17, 2016, 15 pages.

* cited by examiner

ARTICLE OF FOOTWEAR WITH KNITTED COMPONENT HAVING BIASED INTER-TOE MEMBER

RELATED APPLICATIONS

This application claims priority to U.S. Provisional Application Ser. No. 62/147,331 filed on Apr. 14, 2015, which is incorporated by reference herein in its entirety.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal to a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each imparts different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each imparts different properties to various areas of the footwear.

SUMMARY

An article of footwear is disclosed that includes a sole structure and an upper that is attached to the sole structure. The upper includes a forefoot region that is configured to receive a plurality of toes of a foot. The upper includes a first zone having a first elasticity, a second zone having a second elasticity, and a third zone having a third elasticity. The third zone is disposed between the first zone and the second zone. The third elasticity is greater than the first elasticity and the second elasticity. The third zone is configured to bias the first zone and the second zone toward each other. The third zone is biased generally toward the sole structure and configured to be received in a space between two of the plurality of toes of the foot.

A method of manufacturing an article of footwear is also disclosed. The method includes forming an upper of the article of footwear to include a first zone, a second zone, and a third zone that is disposed between the first zone and the second zone. The method also includes attaching a sole structure to the upper. Forming the upper includes providing the first zone with a first elasticity, the second zone with a second elasticity, and the third zone with a third elasticity. The third elasticity is greater than the first elasticity and the second elasticity. Also, forming the upper includes forming the third zone such that the third zone biases the first zone and the second zone toward each other. Furthermore, forming the upper includes forming the third zone such that the third zone is biased toward the sole structure and is configured to be received in a space between two of the plurality of toes of the foot.

Moreover, an article of footwear is disclosed that includes a sole structure with an attachment area. The article of footwear includes an upper that is attached to the attachment area of the sole structure. The upper also includes a knitted component formed of unitary knit construction. The knitted component defines a forefoot region and a heel region of the upper. The forefoot region includes a first zone extending from the attachment area and defining a first cavity configured to receive a hallux of the foot. The first zone has a first elasticity. The forefoot region also includes a second zone extending from the attachment area and defining a second cavity configured to receive a second toe of the foot. The second zone has a second elasticity. The forefoot region additionally includes a third zone extending from the attachment area and disposed between the first zone and the second zone. The third zone has a third elasticity that is greater than the first elasticity and the second elasticity. The third zone is biased toward the sole structure and biased generally toward the heel region. The third region is configured to be received within a space between the hallux and the second toe.

In addition, an upper for an article of footwear is disclosed. The upper is configured to attach to a sole structure. The upper includes a knitted component formed of unitary knit construction. The knitted component defines a sole attachment area that is configured to attach to the sole structure. The knitted component defines a forefoot region of the upper. The forefoot region includes a first zone having a first elasticity, a second zone having a second elasticity, and a third zone having a third elasticity. The third zone is disposed between the first zone and the second zone. The third elasticity is greater than the first elasticity and the second elasticity. The third zone is configured to bias the first zone and the second zone toward each other to define an inter-toe member. The inter-toe member is configured to be biased generally toward the sole structure and is configured to be received in a space between two of the plurality of toes of the foot.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
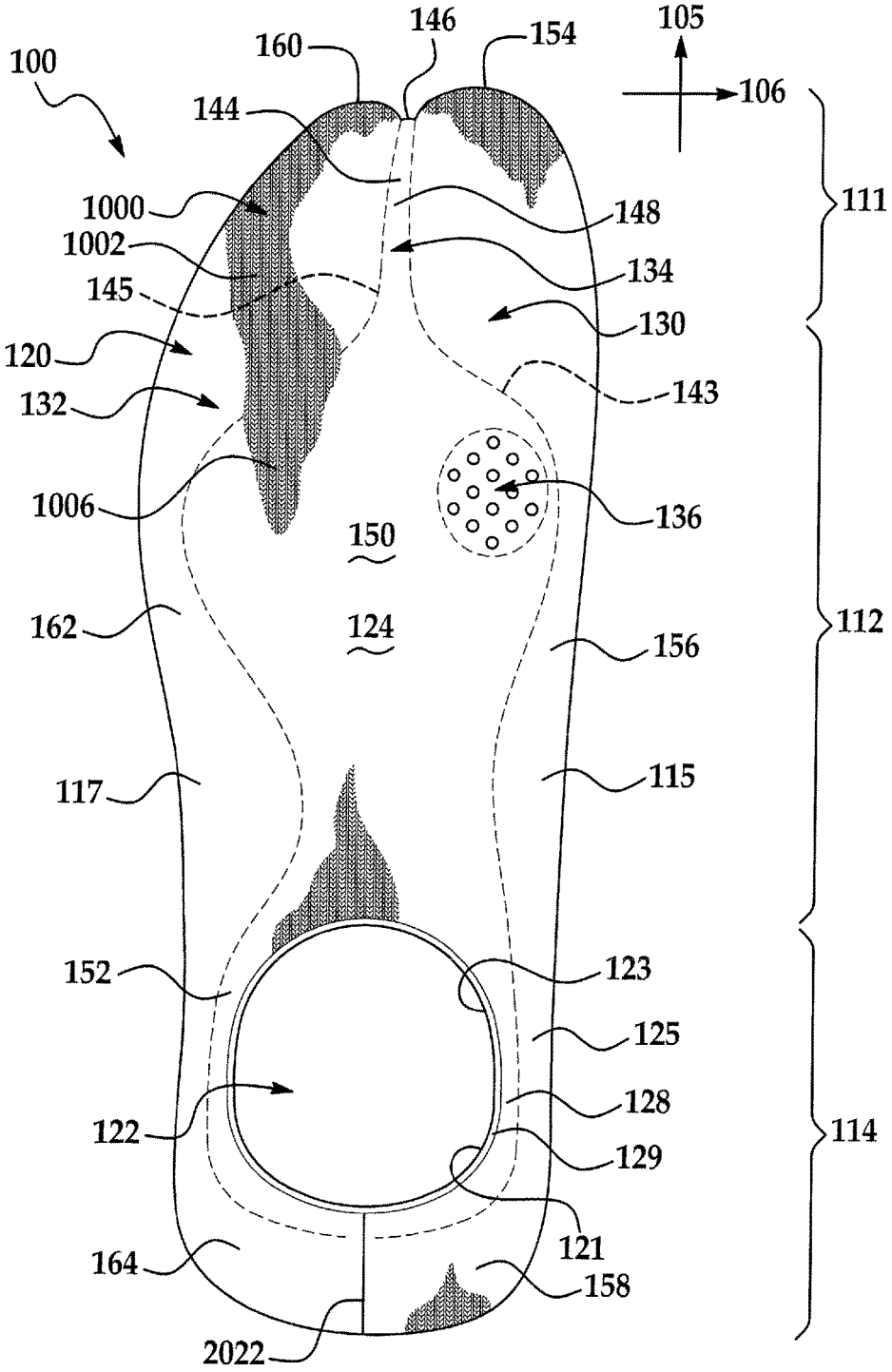
FIG. 1 is a top view of an article of footwear according to exemplary embodiments.

The following discussion and accompanying figures disclose an article of footwear having an upper with a forefoot region that covers the toes and that is at least partially received between toes of the wearer. For example, the upper can include an inter-toe member that wedges between the wearer's toes to engage the forefoot region to the foot. The forefoot region can also conform at least partially to the shape of the toes and/or nest against the toes in some embodiments. Moreover, the forefoot region can be flexible and can resiliently stretch in some embodiments to conform and/or nest against the toes. As such, the upper can engage the forefoot of the wearer and provide improved support.

Furthermore, the following discussion and figures disclose an article of footwear having an upper with two or more zones that differ in one or more predetermined characteristics. For example, two or more zones of the upper can differ in elasticity, stretchability, stretch resistance, and resilience. As a result, the upper can be biased toward a position in which predetermined portions are received between the toes.

Additionally, in some embodiments, the upper can include a knitted component. The knitted component can include one or more knitted elastic areas that allow portions of the upper to be received between the toes.

Footwear Configurations

Referring initially to FIGS. 1-4, an article of footwear 100 is illustrated according to exemplary embodiments. Footwear 100 is disclosed as having a general configuration suitable for running or walking. Concepts associated with footwear 100, including the upper, may also be applied to a variety of other athletic footwear types, including baseball shoes, basketball shoes, cross-training shoes, cycling shoes, football shoes, soccer shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone.

Footwear 100 can also include a medial side 115 and a lateral side 117. Medial side 115 and lateral side 117 can extend through forefoot region 111, midfoot region 112, and heel region 114 in some embodiments. Medial side 115 and lateral side 117 can correspond with opposite sides of footwear 100. More particularly, medial side 115 can correspond with an inside area of the wearer's foot and can face toward the wearer's other foot. Lateral side 117 can correspond with an outside area of the wearer's foot and can face away from the wearer's other foot.

Forefoot region 111, midfoot region 112, heel region 114, lateral side 117, and medial side 115 are not intended to demarcate precise areas of footwear 100. Rather, forefoot region 111, midfoot region 112, heel region 114, lateral side 117, and medial side 115 are intended to represent general areas of footwear 100 to aid in the following discussion. These terms can also be used in reference to individual components of footwear 100.

Figure 2:
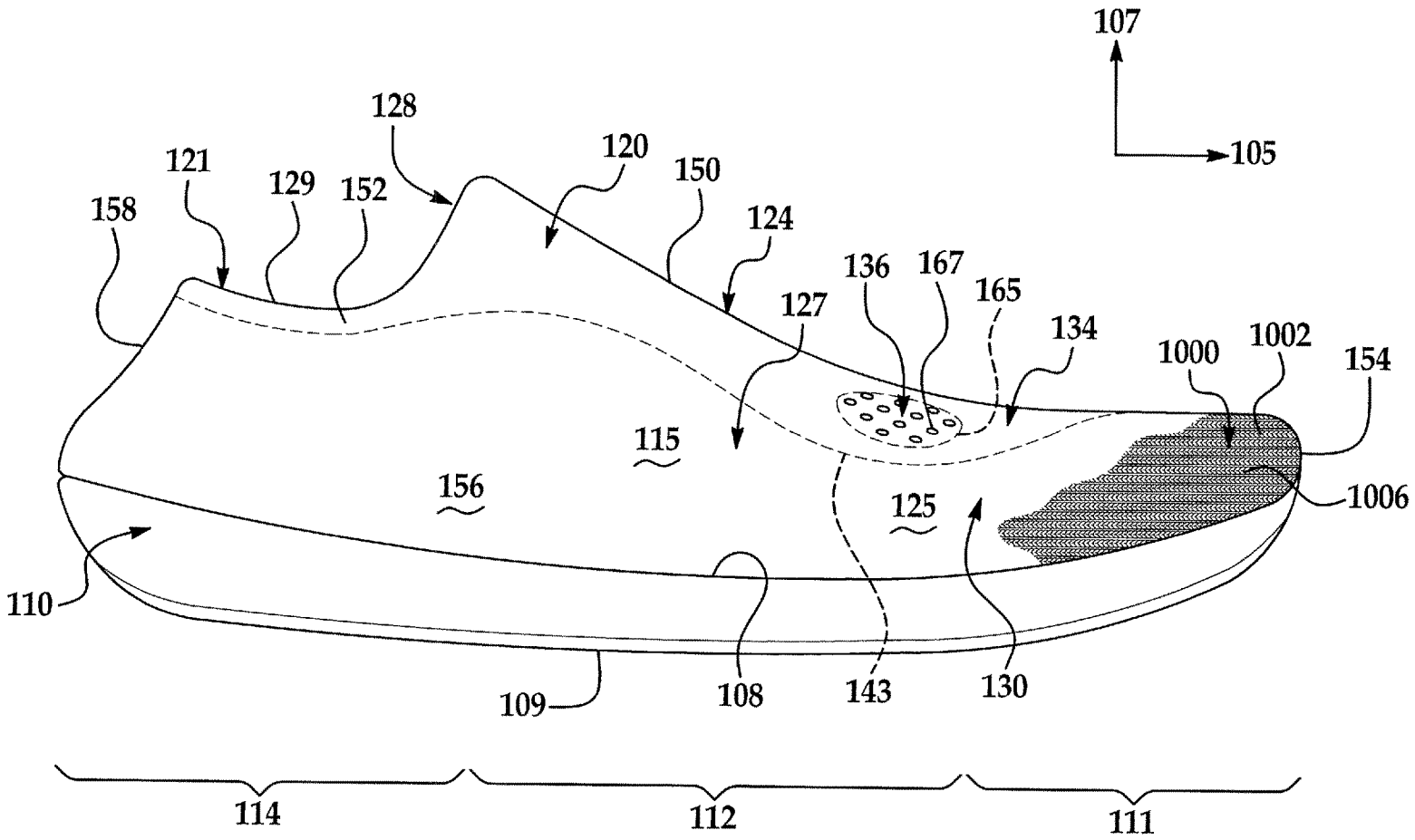
FIG. 2 is a medial view of the article of footwear of FIG. 1.
Figure 3:
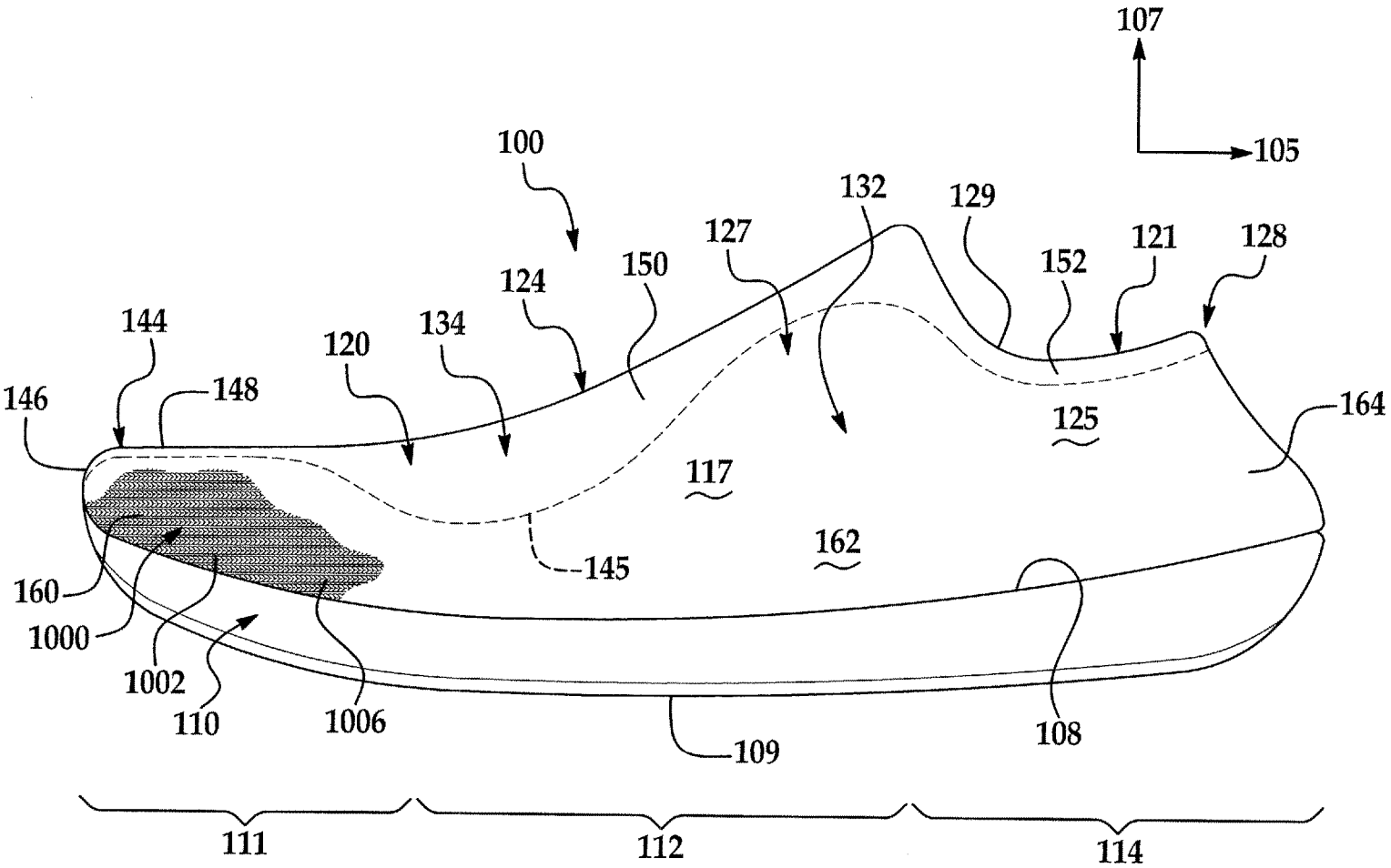
FIG. 3 is a lateral view of the article of footwear of FIG. 1.
Figure 4:
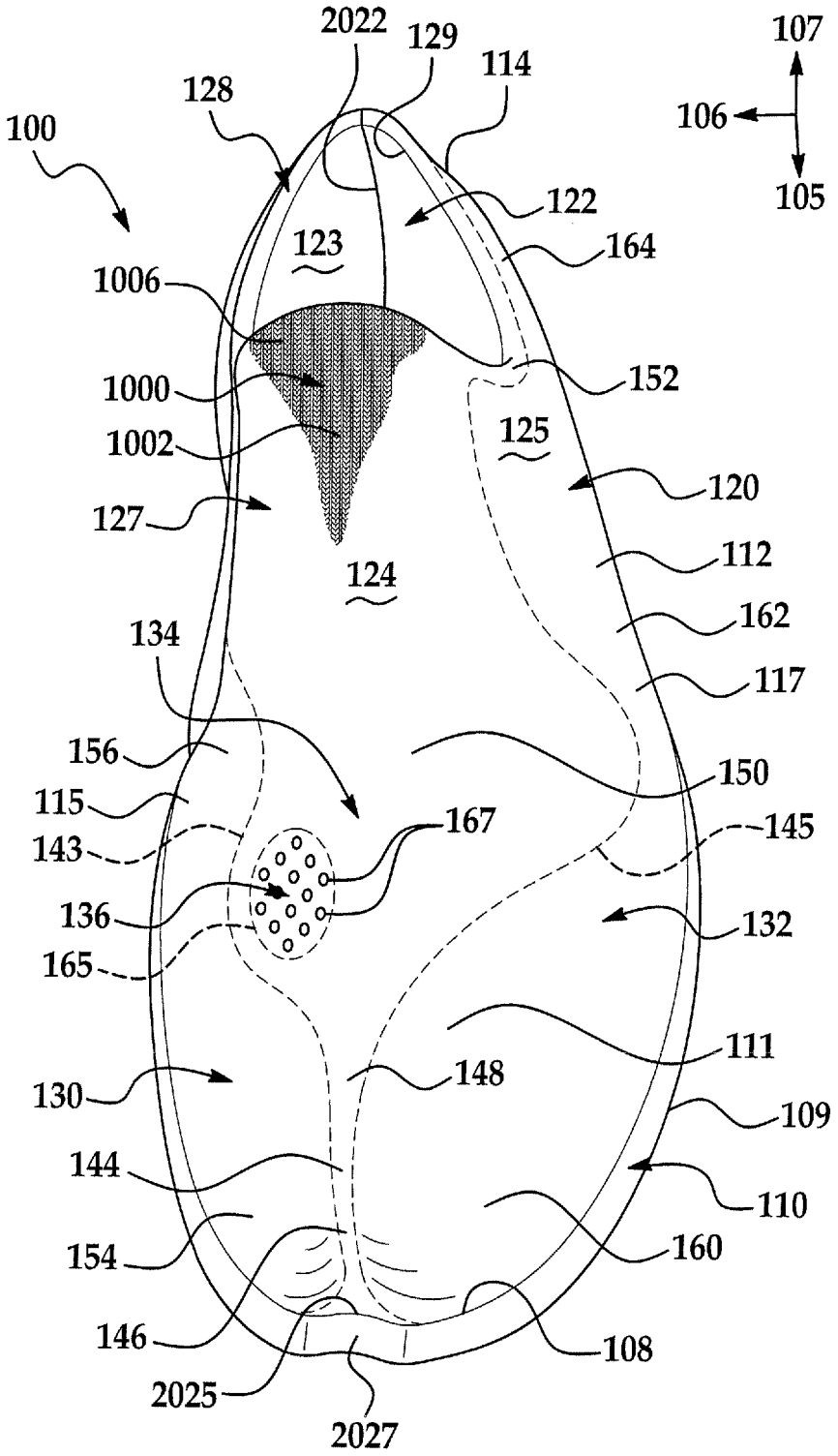
FIG. 4 is a front view of the article of footwear of FIG. 1.

Footwear 100 can also extend along various directions. For example, as shown in FIGS. 2-4, footwear 100 can extend along a longitudinal direction 105 and a vertical direction 107. As shown in FIGS. 1 and 4, footwear 100 can further extend along a transverse direction 106. Longitudinal direction 105 can extend generally between heel region 114 and forefoot region 111. Transverse direction 106 can extend generally between lateral side 117 and medial side 115. Also, vertical direction 107 can extend substantially perpendicular to both longitudinal direction 105 and transverse direction 106. It will be appreciated that longitudinal direction 105, transverse direction 106, and vertical direction 107 are merely included for reference purposes and to aid in the following discussion.

Generally, footwear 100 can include a sole structure 110 and an upper 120. Upper 120 can receive the wearer's foot and secure footwear 100 to the wearer's foot whereas sole structure 110 can extend underneath upper 120 and provide cushioning, traction, and/or support for the wearer's foot.

As shown in FIGS. 2-4, sole structure 110 can be secured to upper 120 and can extend underneath the wearer's foot. Stated differently, sole structure 110 can include an attachment area 108 that faces upper and that is fixed to upper 120. Attachment area 108 can be adhesively attached, lasted, or otherwise attached to upper 120. Also, sole structure 110 can extend between the upper 120 and the ground. Thus, sole structure 110 can include a ground engaging surface 109 that provides traction for the article of footwear 100. In some embodiments, ground engaging surface 109 can be defined by an outsole, and sole structure 110 can additionally include a midsole that includes padding, foam, fluid-filled bladders, or other components that provide cushioning, dampening of impact loads, and the like.

Also, in some embodiments, sole structure 110 can have relatively high flexibility so as to allow relatively high flexibility of upper 120. For example, sole structure 110 can include one or more highly flexible materials. Additionally, ground engaging surface 109 can include openings, such as grooves, sipes, recesses, or other features that increase flexibility of sole structure 110.

Additionally, as shown in FIG. 4, the periphery of sole structure 110 can include a recess 2025 in some embodiments. Recess 2025 can be disposed in forefoot region 111 in some embodiments. As will be discussed, recess 2025 can provide increased flexibility of sole structure 110 at forefoot region 111. Also, in some embodiments, recess 2025 can be substantially aligned with features of upper 120 that have increased elasticity such that recess 2025 accommodates flexure of those areas of upper 120.

As shown in FIGS. 1-4, upper 120 can extend generally upward from attachment area 108, between medial side 115 and lateral side 117 of sole structure 110, and longitudinally from forefoot region 111 to heel region 114 of sole structure 110. Upper 120 can define a void 122 within footwear 100. Stated differently, upper 120 can include an inner surface 123 that defines void 122. Void 122 can receive a foot of a wearer. Upper 120 can additionally include an outer surface 125 that faces opposite inner surface 123. Upper 120 can also define a collar 128 with an upper edge 129 that defines a collar opening 121. Collar opening 121 can provide access to void 122 and can allow passage of the foot into and out of upper 120.

Upper 120 can also include a throat 124 that extends in the longitudinal direction 105 between forefoot region 111 and collar 128, and in the transverse direction 106 between medial side 115 and lateral side 117. In some embodiments, throat 124 can include a tongue. In some embodiments, tongue can be attached to forefoot region 111 of upper 120 and can be detached from medial side 115 and/or lateral side 117. In other embodiments, such as the embodiments of FIGS. 1-4, upper 120 can be substantially continuous between medial side 115 and lateral side 117 across throat 124. As such, upper 120 can be "sock-like" and "tongueless."

Additionally, in some embodiments, footwear 100 can include a securement element, such as a shoelace, cable, wire, strap, buckle, or other suitable implements for securing upper 120 to the wearer's foot. In other embodiments, such as the embodiment of FIGS. 1-4, footwear 100 can be more "sock-like," "lace-less," and/or otherwise without a securement element. In some embodiments, upper 120 can constrict and compress against the wearer's foot for securing footwear 100 to the wearer's foot.

Figure 6:
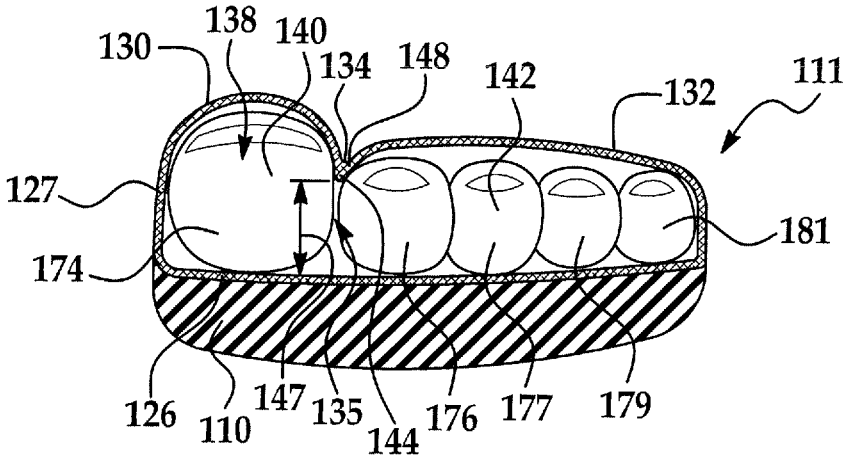
FIG. 6 is a section view of the article of footwear taken along the line 6-6 of FIG. 5, wherein the forefoot region is shown in the neutral position.

In some embodiments, upper 120 can extend both over the wearer's foot and underneath the wearer's foot. More specifically, as shown in FIG. 6, upper 120 can include an underfoot part 126 and an overfoot part 127. Overfoot part 127 can be those areas of upper 120 that are exposed from sole structure 110 and that extend over the wearer's foot. In contrast, underfoot part 126 can be layered directly on sole structure 110, and underfoot part 126 can extend underneath the wearer's foot. In some embodiments, underfoot part 126 can span underneath the foot between opposite peripheral edges of overfoot part 127. As such, underfoot part 126 and overfoot part 127 can cooperate to define the void 122 of the upper 120. It will be appreciated that overfoot part 127 and underfoot part 126 can be a single, integrally attached body. In other embodiments, overfoot part 127 and underfoot part 126 can be removably attached together. In the latter example, overfoot part 127 and underfoot part 126 can form a seam, which is attached via adhesives, stitching, fasteners, or another attachment device. Additionally, it will be appreciated that the underfoot part 126 can be referred to as a "strobel," a "strobel sock," or a "strobel part."

In further configurations, upper 120 may include additional elements. For example, upper 120 can include a toe guard in forefoot region 101 that is formed of a wear-resistant material. Upper 120 can additionally include logos, trademarks, symbols, and placards with care instructions and material information. Those having ordinary skill in the art will appreciate that upper 120 can include still further elements without departing from the scope of the present disclosure.

Also, footwear 100 can additionally include a sockliner that extends underneath the wearer's foot. For example, the sockliner can be a removable insert that is provided within the void 122 and that provides a padded surface underneath the wearer's foot. In some embodiments, underfoot part 126 of upper 120 can be disposed between the sockliner and sole structure 110.

In some embodiments, upper 120 can include an inter-toe member 144 that is at least partially received between the wearer's toes. The inter-toe member 144 can help engage the upper 120 to the wearer's foot as will be discussed. Furthermore, inter-toe member 144 can cause upper 120 to conform closely to the surfaces of the toes for engaging upper 120 with the foot. Additionally, in some embodiments, inter-toe member 144 can wedge between and maintain some degree of separation between the toes. Thus, in some embodiments, inter-toe member 144 can separate the toes to increase the wearer's stability and/or thrusting power when running. Also, in some embodiments, inter-toe member 144 can act as a barrier to prevent the toes from rubbing together uncomfortably.

Inter-toe member 144 can be defined on a portion of upper 120, which is directed inward into void 122 and which can be received between the wearer's toes. For example, inter-toe member 144 can be a portion of upper 120 that is partially folded or wrinkled and directed inward into the void 122.

In some embodiments, upper 120 can be stretchable between an unstretched position and a stretched position. Upper 120 can include inter-toe member 144 when upper 120 is in the unstretched position in some embodiments. For example, when the wearer takes off footwear 100 and upper 120 is unstretched, portions of upper 120 can be directed inward into void 122 to define inter-toe member 144. Additionally, when the foot is received within void 122, inter-toe member 144 can be elastically biased toward a space 135 defined between toes of the wearer's foot. Furthermore, in some embodiments, upper 120 can stretch to accommodate the foot, and in this stretched position, inter-toe member 144 can be elastically biased toward the space 135.

Furthermore, inter-toe member 144 can be defined in a zone of upper 120 having relatively high elasticity. In some embodiments, for example, the highly elastic zone can bias and pull adjacent areas toward each other, causing the highly elastic zone to draw inward into void 122. In some embodiments, the highly elastic zone can at least partially fold inward on itself to form a fold, indentation wrinkle, cleft, or cleavage, which defines inter-toe member 144.

Furthermore, in some embodiments, upper 120 can include a plurality of different regions, areas, or zones that differ in one or more characteristics. For example, the different regions can differ in elasticity, stretchability, stretch-resistance, flexibility, breathability, color, moisture wicking ability, insulation, texture, softness, thickness, stitch density, or in other ways.

For example, in some embodiments discussed below, upper 120 can include multiple zones that differ in elasticity. "Elasticity" as used herein will be understood generally as the tendency of the upper 120 to stretch out under the influence of a stretching force and to recover toward an unstretched condition once the stretching load is reduced. The stretching and recovery can occur in the longitudinal direction 105, the transverse direction 106, and/or the vertical direction 107.

In some embodiments, inter-toe member 144 can be formed in a zone having higher elasticity, and zones of upper 120 that are adjacent to inter-toe member 144 can have lower elasticity. Thus, the zone forming inter-toe member 144 can pull those adjacent areas toward each other, causing upper 120 to conform and nest forefoot area 111 against the metatarsals, toe joints, and/or toes of the wearer's foot. Stated differently, forefoot area 111 of upper 120 can shape against the toes to form multiple toe-shaped cavities. As such, upper 120 can be secured and engaged to the wearer's foot and can flex with the wearer's foot during walking, running, or other activities.

Configurations of Forefoot Region and Other Regions of Upper

Referring now to FIGS. 1, 4, and 5-8, forefoot region 111 and other regions of upper 120 will be discussed according to exemplary embodiments. In some embodiments, forefoot region 111 can generally include a first zone 130, a second zone 132, and a third zone 134.

Third zone 134 can be disposed between first zone 130 and second zone 132 in some embodiments. For example, first zone 130 can be disposed proximate the medial side 115 of upper 120, second zone 132 can be disposed proximate the lateral side 117, and third zone 134 can be disposed centrally, between first zone 130 and second zone 132. Also, in some embodiments, first zone 130, second zone 132, and/or third zone 134 can extend rearward from forefoot region 111, generally into midfoot region 112. Additionally, in some embodiments, first zone 130, second zone 132, and/or third zone 134 can extend rearward from forefoot region 111, generally into heel region 114.

First zone 130 can have a first elasticity, second zone 132 can have a second elasticity, and third zone 134 can have a third elasticity. In some embodiments, the elasticity of third zone 134 can be greater than the elasticity of first zone 130 and the elasticity of second zone 132. As such, when a stretching load is applied to upper 120, third zone 134 can stretch out more than first zone 130 and second zone 132. Stated differently, first zone 130 and second zone 132 can resist stretching while third zone 134 stretches due to the stretching load. In some embodiments, first zone 130 and second zone 132 can be substantially inelastic while third zone 134 can be elastic and stretchable. Additionally, in some embodiments, first zone 130 and second zone 132 can have substantially equal elasticities, and third zone 134 can have greater elasticity than both.

These stretching and elasticity characteristics can be observed and measured in various ways. For example, when the upper 120 is unstretched and in a neutral position, the widths of first zone 130, second zone 132, and third zone 134 can be measured in a direction extending generally between the medial side 115 and the lateral side 117. Then, a stretching force or load can be applied to stretch and elongate the upper 120 substantially in the transverse direction 106. The increase in widths of first zone 130, second zone 132, and third zoned 134 can then be calculated. In additional embodiments, independent specimens of first zone 130, second zone 132, and third zone 134 can be stretch tested individually and compared. Additionally, in some cases, these stretching and elasticity characteristics can be measured using the procedure set forth in ASTM D2594 or its equivalent. In other cases, these stretching and elasticity characteristics can be measured using other industry-accepted standard testing procedures. In some embodiments, third zone 134 can stretch out elastically at least 20% more than first zone 130 and second zone 132 when subjected to the stretching load. In additional embodiments, third zone 134 can stretch out elastically at least 40% more than first zone 130 and second zone 132 when subjected to the stretching load.

The differences in elasticity between first zone 130, second zone 132, and third zone 134 can be achieved in various ways without departing from the scope of the present disclosure. For example, in some embodiments, first zone 130, second zone 132, and third zone 134 can be made from different materials of different elasticity. Alternatively, in some embodiments, the first zone 130, second zone 132, and third zone 134 can include the same materials, but first zone 130, second zone 132, and third zone 134 can be structurally different to provide the differences in elasticity. More specifically, in some embodiments, third zone 134 can have a different material density such that third zone 134 is more elastic than first zone 130 and second zone 132.

Figure 7:
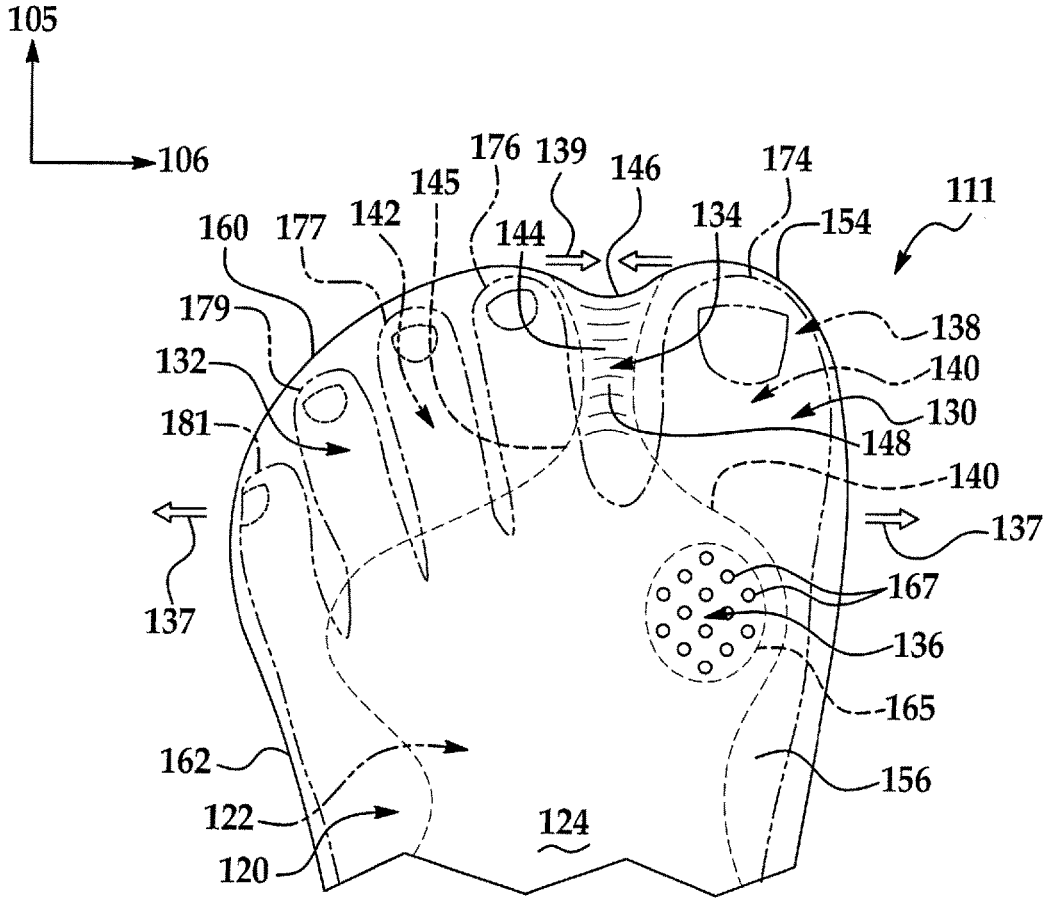
FIG. 7 is a top view of the forefoot region of the article of footwear of FIG. 1, wherein the forefoot region is shown in a stretched position.
Figure 8:
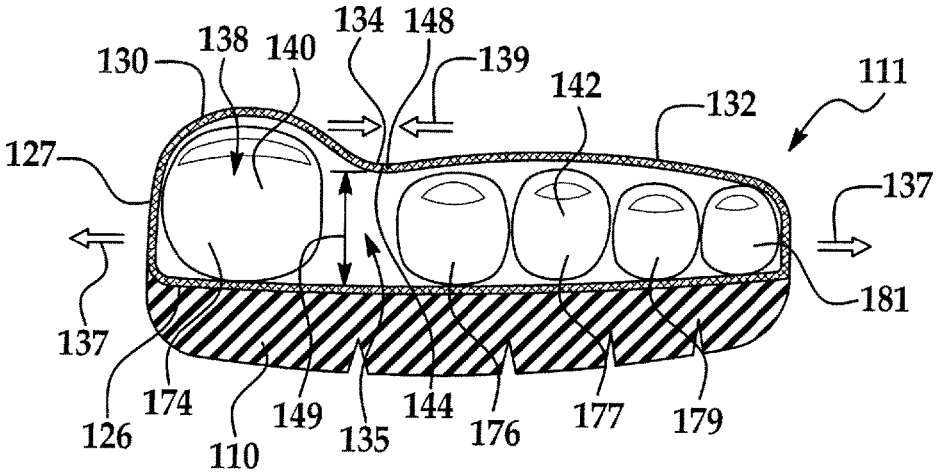
FIG. 8 is a section view of the forefoot region of the article of footwear shown in the stretched position.

As shown in FIGS. 7 and 8, forefoot region 111 can stretch under the influence of a stretching force indicated by arrows 137. In the embodiments illustrated, the stretching load is directed in the transverse direction 106 and can occur, for example, as the toes are spread apart. As shown, third zone 134 can stretch to a high degree under the influence of the stretching force represented by arrows 137.

Figure 5:
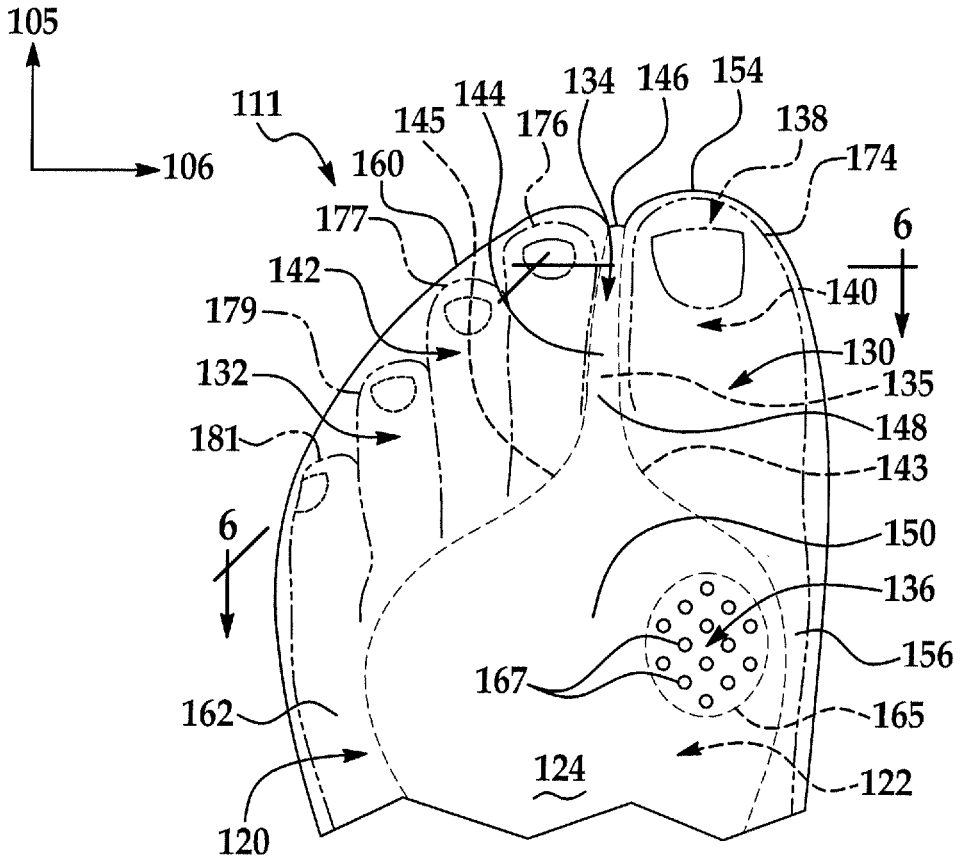
FIG. 5 is a top view of a forefoot region of the article of footwear of FIG. 1, wherein the forefoot region is shown in a neutral position.

Then, as the stretching load is reduced on the upper 120, forefoot region 111 can recover toward the position represented in FIGS. 5 and 6. For example, in some embodiments, as the stretching load is reduced, third zone 134 can recover resiliently from the stretched state toward an unstretched state. As a result, third zone 134 can bias first zone 130 and second zone 132 toward each other as indicated by arrows 139.

Additionally, in some embodiments, the elasticity of third zone 134 can bias third zone 134 generally toward sole structure 110. For example, third zone 134 can be drawn and biased toward sole structure 110 to form inter-toe member 144 that is received between the toes of the wearer.

More specifically, as shown in FIG. 6, third zone 134 can be spaced at a distance 147 from sole structure 110 when forefoot region 111 is unstretched. As forefoot region 111 is stretched, the distance 147 between third zone 134 and sole structure 110 can increase to distance 149 as shown in FIG. 8. As the stretching force is reduced, third zone 134 can bias and recover back toward the sole structure 110 as shown in FIG. 6. As third zone 134 is drawn downward toward sole structure 110, third zone 134 can be received between two of the wearer's toes. Stated differently, third zone 134 can resiliently recover from a stretched position to be received in space 135 defined between two of the plurality of toes 138 (FIGS. 5 and 6).

Inter-toe member 144 can separate forefoot region 111 into a plurality of cavities, each configured to receive one or more of the wearer's toes. These cavities can at least partially conform and/or nest against the toes. For example, first zone 130 can form a cavity that conforms and/or nests against one or more toes, and second zone 132 can form a cavity that conforms and/or nests against one or more other toes. More specifically, in some embodiments, first zone 130 and third zone 134 can cooperate to define a first toe cavity 140 that receives one or more toes. Inner surface 123 at this area of upper 120 can define first toe cavity 140, and this portion of inner surface 123 can nest against the toe(s) within first toe cavity 140. Similarly, second zone 132 and third zone 134 can cooperate to define a second toe cavity 142 that receives one or more other toes. Inner surface 123 at this area of upper 120 can define second toe cavity 142, and this portion of inner surface 123 can nest against the toe(s) within second toe cavity 142. Additionally, third zone 134 can be drawn generally into a space 135 between the toes to define inter-toe member 144.

Accordingly, upper 120 can securely engage with the wearer's foot. Inter-toe member 144 can draw upper 120 within the inter-toe space 135 to engage the foot. Also, elasticity of inter-toe member 144 can cause first zone 130 and/or second zone 132 to nest against the wearer's toes 138 to engage the foot.

Specific embodiments of forefoot region 111 and other portions of upper 120 will now be discussed in reference to the embodiments of FIGS. 1-8. As stated, forefoot region 111 can include first zone 130, second zone 132, and third zone 134. Third zone 134 will be discussed initially.

An exemplary embodiment of third zone 134 is defined in the figures by a first boundary 143 and a second boundary 145, each represented by a respective broken line in the figures. As shown, first boundary 143 and second boundary 145 can extend generally in the longitudinal direction 105. Thus, third zone 134 can be generally elongate and can extend in the longitudinal direction 105. Also, in some embodiments, third zone 134 can extend from attachment area 108 of sole structure 110, along throat 124 of upper 120, toward collar 128.

In some embodiments, third zone 134 can be sub-divided into a front portion 146 and a lofted portion 148. The front portion 146 can extend from the attachment area 108 of sole structure 110 and away from sole structure 110, generally in the vertical direction 107. Front portion 146 can be disposed generally in front of inter-toe space 135. In some embodiments, front portion 146 can stretch elastically in both the vertical direction 107 and the transverse direction 106.

Also, lofted portion 148 can extend from front portion 146, generally in the longitudinal direction 105 toward heel region 114. As shown in FIG. 6, lofted portion 148 can be spaced from sole structure 110 at a distance 147 and can be disconnected from sole structure 110. Lofted portion 148 can be disposed generally above the inter-toe space 135. In some embodiments, lofted portion 148 can stretch elastically in both the transverse direction 106 and the longitudinal direction 105.

Additionally, third zone 134 can include a vamp portion 150. Vamp portion 150 can extend from lofted portion 148 in the longitudinal direction 105. Also, vamp portion 150 of third zone 134 can extend generally along throat 124 toward heel region 114. As such, vamp portion 150 can stretch and/or conform against the superior area of the wearer's foot, for example, along the metatarsal arch. As shown in FIG. 1, vamp portion 150 can be wider than lofted portion 148 and front portion 146. In some embodiments, the transition between vamp portion 150 and lofted portion 148 can correspond to one or more joints on the toes or foot.

Furthermore, third zone 134 can include a collar portion 152. Collar portion 152 can branch away from vamp portion 150 and can extend at least partially about collar 128. For example, in some embodiments, collar portion 152 of third zone 134 can extend continuously around the collar opening 121.

First zone 130 can be disposed primarily on medial side 115 of upper 120. In some embodiments, first zone 130 can be sub-divided into a front portion 154 and a medial portion 156. Front portion 154 can extend from the attachment area 108 of sole structure 110 and away from sole structure 110, generally in the vertical direction 107. Also, medial portion 156 can extend from front portion 154, generally in the longitudinal direction 105 along medial side 115 toward heel region 114. Also, medial portion 156 can be defined between sole structure 110 and first boundary 143. Furthermore, medial portion 156 can terminate proximate heel region 114. As such, front portion 154 can be disposed generally in front of toes 138, and medial portion 156 can be disposed on the medial area, inferior arch, and/or other inside areas of the wearer's foot.

Additionally, in some embodiments, second zone 132 can be disposed primarily on lateral side 117 of upper 120. In some embodiments, second zone 132 can be sub-divided into a front portion 160 and a lateral portion 162. The front portion 160 can extend from the attachment area 108 of sole structure 110 and away from sole structure 110, generally in the vertical direction 107. Also, lateral portion 162 can extend from front portion 160, generally in the longitudinal direction 105 along lateral side 117 toward heel region 114. Also, lateral portion 162 can be defined between sole structure 110 and second boundary 145. Furthermore, lateral portion 162 can terminate proximate heel region 114. As such, front portion 160 can be disposed generally in front of toes 138, and lateral portion 162 can be disposed on the outer, lateral areas of the wearer's foot.

In some embodiments, upper 120 can include additional zones. For example, upper 120 can include a fourth zone 136 as shown in FIGS. 1, 2, 4, and 5. In some embodiments, fourth zone 136 can be defined by a boundary 165, represented by a broken line in FIGS. 1, 2, 4, and 5. In some embodiments, fourth zone 136 can be encompassed and surrounded within another zone. For example, fourth zone 136 can be encompassed and disposed within first zone 130. As such, fourth zone 136 can be referred to as a "sub-zone" of first zone 130. Also, fourth zone 136 can be disposed proximate forefoot region 111 in some embodiments. Also, fourth zone 136 can be rounded, for example. Specifically, fourth zone 136 can be substantially circular in some embodiments. Fourth zone 136 can be disposed proximate forefoot region 111 proximate medial side 115, for example, to cover and correspond to a joint of the wearer's big toe (i.e., first toe, hallux). As such, fourth zone 136 can distribute compression forces that upper 120 applies to the joint for increased comfort.

Fourth zone 136 can differ in one or more characteristics from at least one of the other zones of upper 120. For example, in some embodiments, fourth zone 136 can have a different stretchability, elasticity, resiliency, porosity, breathability, and/or density as compared to the other zone(s). In some embodiments, fourth zone 136 can include a plurality of openings 167 that provide these differences. Openings 167 can be through-holes and can create a mesh-like structure in some embodiments.

Referring now to FIGS. 5 and 6, the fit of the forefoot region 111 on the wearer's toes will be explained according to exemplary embodiments. As shown, the first zone 130 and the third zone 134 can cooperate to define the first toe cavity 140, and first toe cavity 140 can receive the first toe 174 (i.e., big toe or hallux) of the wearer. Also, the second zone 132 and the third zone 134 can cooperate to define the second toe cavity 142. In some embodiments, second toe cavity 142 can receive one or more of the toes that are disposed laterally away from the first toe 174. Specifically, in some embodiments, second toe cavity 142 can receive the second toe 176, the third toe 177, the fourth toe 179, and the fifth toe 181 of the wearer.

Furthermore, the third zone 134 can be drawn toward the sole structure 110 to define inter-toe member 144. For example, third zone 134 can be drawn at least partially into the inter-toe space 135 between two toes, specifically the first toe 174 and the second toe 176. In some embodiments, front portion 146 can bias toward attachment area 108 in the vertical direction 107. Also, front portion 146 can bias rearwardly slightly toward heel region 114 in longitudinal direction 105, and lofted portion 148 can be biased downward in the vertical direction 107 to define inter-toe member 144.

In some embodiments, for example, when upper 120 compresses against the foot, first zone 130 and/or third zone 134 can compress, conform, and/or nest against the first toe 174. Likewise, when upper 120 compresses against the foot, the second zone 132 and/or third zone 134 can compress, conform, and/or nest against the other toe(s). Meanwhile, inter-toe member 144 can be drawn into and can engage the areas of foot between the first toe 174 and the second toe 176. Accordingly, the upper 120 can fit snugly and can engage the wearer's foot. This can improve comfort and/or support for the wearer.

Embodiments of Materials and Construction of Upper

Upper 120 can be constructed from any suitable materials. Also, upper 120 can be constructed from one or more parts. In some embodiments, upper 120 can be formed from multiple material elements (e.g., polymer foam, polymer sheets, leather, synthetic leather) that are joined together through stitching, adhesives, bonding, or fasteners, for example. In some embodiments, separate parts can define first zone 130, second zone 132, and third zone 134.

In other embodiments, the majority of upper 120 can be formed from a unitary, monolithic, single-body. As such, upper 120 can be constructed in an efficient manner and can include a relatively low number of parts. Additionally, upper 120 can flex with, conform against, and/or nest against the wearer's foot because of the single-body construction.

Additionally, in some embodiments, upper 120 can be at least partially formed from a textile element. Specifically, upper 120 can be at least partially formed via a knitting process in some embodiments. In other embodiments, upper 120 can be at least partially formed via a weaving process. As such, upper 120 can be lightweight, breathable, and soft to the touch. However, the fabric can be constructed such that upper 120 is durable and strong. Moreover, the knitting or weaving processes can provide manufacturing efficiencies and can result in a relatively low amount of waste. Also, the fabric can provide elasticity to the upper 120. For example, the fabric can have some degree of elasticity due to the knitted or woven construction. Furthermore, in some embodiments, the fabric can be knitted or woven from elastic and stretchable yarns, which further enhance the stretchiness of the upper.

In some embodiments, upper 120 can be at least partially formed from a knitted component 1000 as indicated in FIGS. 1-4. Knitted component 1000 can at least partially extend through forefoot region 111, midfoot region 112, and/or heel region 114 of upper 120. Knitted component 1000 can also extend along lateral side 104, medial side 105, over forefoot region 101, and/or around heel region 103. In addition, knitted component 1000 can at least partially define inner surface 123 and/or outer surface 125 of upper 120.

As will be discussed, knitted component 1000 can provide the upper 120 with weight savings as compared with other conventional uppers. Additionally, in some embodiments, knitted component 1000 can be configured with different zones having different characteristics. For example, one or more predetermined zones can have more elasticity and stretchability than other zones. Stated differently, certain zones can have more stretch resistance than other zones. Also, knitted component 1000 can provide the upper 120 with aesthetically pleasing features and textures. Still further, knitted component 1000 can provide advantages in the manufacture of footwear 100. Other advantages due to the knitted component 1000 will be explored in detail below.

In some embodiments, knitted component 1000 can be made at least partially through a flat knitting or circular knitting process. An exemplary flat-knitted component 1000 is shown in plan view in FIG. 9.

Knitted component 1000 can be formed of unitary knit construction. As defined herein and as used in the claims, the term "unitary knit construction" means that knitted component 1000 is formed as a one-piece element through a knitting process. That is, the knitting process substantially forms the various features and structures of knitted component 1000 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of knitted component 1000. With this arrangement, a one-piece element of unitary knit construction is provided.

Although portions of knitted component 1000 may be joined to each other following the knitting process, knitted component 1000 remains formed of unitary knit construction because it is formed as a one-piece knit element. Moreover, knitted component 1000 remains formed of unitary knit construction when other elements (e.g., an inlaid strand, a closure element, logos, trademarks, placards with care instructions and material information, and other structural elements) are added following the knitting process.

Thus, upper 120 can be constructed with a relatively low number of material elements. This can decrease waste while also increasing the manufacturing efficiency and recyclability of upper 120. Additionally, knitted component 1000 of upper 120 can incorporate a smaller number of seams or other discontinuities. This can further increase manufacturing efficiency of footwear 100. Moreover, inner surface 123 and outer surface 125 of upper 120 can be substantially smooth and uniform to enhance the overall comfort of footwear 100.

Figure 9:
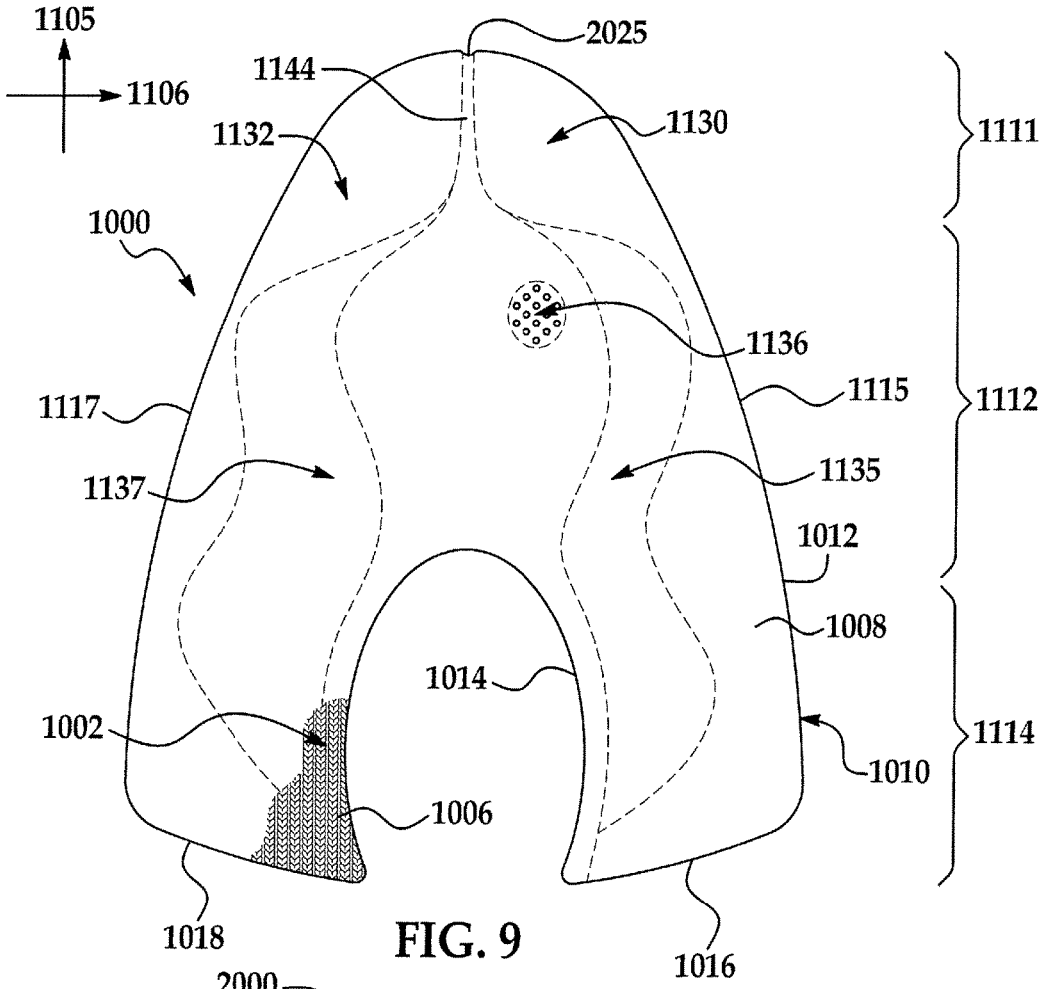
FIG. 9 is a plan view of a knitted component of the article of footwear of FIG. 1 according to exemplary embodiments.

In some embodiments, knitted component 1000 can be primarily defined by a knit element 1002. As shown in FIG. 9, knit element 1002 of knitted component 1000 may be formed from at least one yarn, cable, fiber, filament, or other strand that is manipulated (e.g., with a knitting machine) to form a plurality of intermeshed loops that define a plurality of courses and wales.

Knitted component 1000 can also generally include at least one tensile element. In some embodiments, tensile element can be a yarn, cable, fiber, filament, or other elongate strand. Tensile element can extend across and can be attached to knit element 1002. In some embodiments, tensile element can be inlaid within a course and/or a wale of knit element 1002. As such, the tensile elements can be formed of unitary knit construction with knit element 1002. In other embodiments, tensile element can be laid across and attached to knit element 1002. Tensile elements can provide support to knitted component 1000. More specifically, in some embodiments, tension within tensile elements can allow knitted component 1000 to resist deformation, stretching, or otherwise provide support for the wearer's foot during running, jumping, or other movements of the wearer's foot.

Knitted component 1000, knit element 1002, and/or tensile element can incorporate the teachings of one or more of commonly-owned U.S. Pat. No. 8,490,299 to Dua et al., filed on Dec. 18, 2008, and granted on Jul. 23, 2013, and U.S. patent application Ser. No. 13/048,514 to Huffa et al., entitled "Article Of Footwear Incorporating A Knitted Component," filed on Mar. 15, 2011 and published as U.S. Patent Application Publication Number 2012/0233882 on Sep. 20, 2012, both of which are hereby incorporated by reference in their entirety.

Knit element 1002 can be formed from one or more yarns 1006 of any suitable type. For example, at least one yarn 1006 of knit element 1002 can be made from cotton, elastane, rayon, wool, nylon, polyester, or other material. Also, in some embodiments, at least one yarn 1006 can be elastic and resilient. As such, yarn 1006 can be elongated from a first length, and yarn 1006 can be biased to recover to its first length. Thus, such an elastic yarn 1006 can allow knit element 1002 to stretch elastically and resiliently under the influence of a force. When that force is reduced, knit element 1002 can recover back to its neutral position.

Furthermore, in some embodiments, at least one yarn 1006 can be at least partially formed from a thermoset polymer material that can melt when heated and that can return to a solid state when cooled. As such, yarn 1006 can be a fusible yarn and can be used to join two objects or elements together. In additional embodiments, knit element 1002 can include a combination of fusible and non-fusible yarns. In some embodiments, for example, knitted component 1000 and upper 120 can be constructed according to the teachings of U.S. Patent Publication No. 2012/0233882, which published on Sep. 20, 2012, the disclosure of which is hereby incorporated by reference in its entirety.

Additionally, in some embodiments, a single yarn 1006 can form each of the courses and wales of knit element 1002. In other embodiments, knit element 1002 can include a plurality of yarns 1006. For example, different yarns 1006 can form different courses and/or different wales. In additional embodiments, a plurality of yarns can be plated together and can cooperate to define a common loop, a common course and/or a common wale of knit element 1002.

Features of knitted component 1000 illustrated in FIG. 9 will now be discussed in greater detail according to exemplary embodiments. Knitted component 1000 can define features of the upper 120 shown in FIGS. 1-4. As such, knitted component 1000 can include a forefoot region 1111, a midfoot region 1112, and a heel region 1114 that define forefoot region 111 of upper 120, midfoot region 112 of upper 120, and heel region 114 of upper 120, respectively. Also, knitted component 1000 can include a medial side 1115 that defines medial side 115 of upper 120, and knitted component 1000 can include a lateral side 1117 that defines lateral side 117 of upper 120.

In FIG. 9, knitted component 1000 is shown in plan view such that knitted component 1000 appears flat and sheet-like. An outer boundary of knitted component 1000 can be defined by a peripheral edge 1010. Also, knitted component 1000 can include a front surface 1008 that spans between opposing segments of peripheral edge 1010. Although not shown in FIG. 9, knitted component 1000 can also include a back surface that opposes front surface 1008.

Peripheral edge 1010 can be sub-divided into a plurality of segments. For example, edge 1010 can include a substantially U-shaped first segment 1012. Edge 1010 can also include a substantially U-shaped second segment 1014. Moreover, edge 1010 can include a third segment 1016 and a fourth segment 1018. Third segment 1016 and/or fourth segment 1018 can be substantially straight. Also, third segment 1016 can extend between the ends of first and second segments 1012, 1014 proximate medial side 1115, and fourth segment 1018 can extend between ends of first and second segments 1012, 1014 proximate lateral side 1117.

In some embodiments, front surface 1008 of knitted component 1000 can define outer surface 125 of upper 120 and the opposing back surface of knitted component 1000 can define inner surface 123 of upper 120. In other embodiments, a skin or other object can be layered and attached to knitted component 1000, and the skin or other object can define the inner surface 123 or outer surface 125 of upper 120.

Knitted component 1000 can also define the plurality of zones of upper 120 discussed above in relation to FIGS. 1-4. The boundaries of the different zones are indicated in FIG. 9 with broken lines according to exemplary embodiments.

As shown, knitted component 1000 can include a first knit zone 1130 that at least partially defines first zone 130 of upper 120. Knitted component 1000 can further include a second knit zone 1132 that at least partially defines second zone 132 of upper 120. Moreover, knitted component 1000 can additionally include a third knit zone 1134 that at least partially defines third zone 134 of upper 120. Furthermore, knitted component 1000 can include a fourth knit zone 1136 that at least partially defines fourth zone 136 of upper 120. As shown in FIG. 9, knitted component 1000 can additionally include a fifth knit zone 1135 and a sixth knit zone 1137, which will be discussed in detail below.

In the embodiment of FIG. 9, for example, first knit zone 1130 can be disposed generally on the medial side 1115 of knitted component 1000 and can extend generally in the longitudinal direction 1105 from forefoot region 1111, through midfoot region 1112, to heel region 1114. Also, first knit zone 1130 can extend along first segment 1012 of peripheral edge 1010 on medial side 1115, and first knit zone 1130 can also extend along third segment 1016 of peripheral edge 1010 in some embodiments.

Additionally, second knit zone 1132 can be disposed generally on the lateral side 1117 of knitted component 1000 and can extend generally in the longitudinal direction 1105 from forefoot region 1111, through midfoot region 1112, to heel region 1114 in some embodiments. Also, second knit zone 1132 can extend along first segment 1012 of peripheral edge 1010 on medial side 1117, and second knit zone 1132 can also extend along fourth segment 1018 of peripheral edge 1010 in some embodiments.

Furthermore, third knit zone 1134 can be disposed centrally on knitted component 1000 and can extend generally in the longitudinal direction 1105 from forefoot region 1111, through midfoot region 1112, to heel region 1114 in some embodiments. Also, third knit zone 1134 can be disposed between first zone 1130 and second zone 1132. Additionally, third knit zone 1134 can extend from first segment 1012 of peripheral edge 1010 toward second segment 1014 of peripheral edge 1010. In some embodiments, third knit zone 1134 can branch apart such that one branch extends to third segment 1016 and the other branch extends to fourth segment 1018 of peripheral edge 1010.

Moreover, fourth knit zone 1136 can be rounded and can be disposed in midfoot region 1112, proximate forefoot region 1111. Fourth knit zone 1136 can be surrounded by third knit zone 1134 and can be disposed closer to medial side 1115 than lateral side 1117.

In some embodiments, fifth knit zone 1135 can be disposed proximate medial side 1115 and can extend generally in the longitudinal direction 1105 from midfoot region 1112 to heel region 1114. Fifth knit zone 1135 can be spaced away from peripheral edge 1010. In some embodiments, fifth knit zone 1135 can be bordered on one side by first knit zone 1130 and on the other side by third knit zone 1134.

Additionally, in some embodiments, sixth knit zone 1137 can be disposed proximate lateral side 1117 and can extend generally in the longitudinal direction 1105 from midfoot region 1112 to heel region 1114. Sixth knit zone 1137 can be spaced away from peripheral edge 1010. In some embodiments, sixth knit zone 1137 can be bordered on one side by second knit zone 1132 and on the other side by third knit zone 1134.

The different zones can differ in one or more characteristics as discussed above with respect to FIGS. 1-8. Thus, in some embodiments, third knit zone 1134 can be more elastic than first zone 1130 and second zone 1132. Furthermore, in some embodiments, third knit zone 1134 can be more elastic, more resilient, and/or more stretchable than fifth zone 1135 and sixth zone 1137.

This difference can be a result of knitting third zone 1134 from yarns that are more elastic than the yarns knitted in the other zones. Also, fusible yarns can be knitted and fused within first zone 1130, second zone 1132, fifth zone 1135, and/or sixth zone 1137, whereas third zone 1134 can be devoid of fusible yarns.

In a specific embodiment, third knit zone 1134 can be more elastic than each of the first knit zone 1130, second knit zone 1132, fifth knit zone 1135, and sixth knit zone 1137. Also, fifth and sixth knit zones 1135, 1137 can have substantially equal elasticity to each other, and fifth and sixth knit zones 1135, 1137 can have greater elasticity than first and second knit zones 1130, 1132. Furthermore, first and second knit zones 1130, 1132 can have substantially equal elasticity. Accordingly, central regions of knitted component 1000 can exhibit higher elasticity and stretchability for conforming knitted component 1000 to the foot whereas peripheral regions of knitted component 1000 can have greater stiffness for supporting the wearer's foot.

Furthermore, fourth knit zone 1136 can be more porous than the other knit zones of knitted component 1000. For example, fourth knit zone 1136 can include one or more holes. This increased porosity can be a result of the knitting operation used to form fourth knit zone 1136. For example, fourth knit zone 1136 can be knit using a so-called "mesh-knit" structure.

Also, because of its increased elasticity, third knit zone 1134 can elastically bias or pull first and fifth knit zones 1130, 1135 generally toward second and sixth knit zones 1132, 1137 in the transverse direction 1106. Additionally, in forefoot region 1111, an inter-toe area 1144 of third knit zone 1134 can bias or pull first knit zone 1130 and second knit zone 1132 toward each other. Accordingly, inter-toe area 1144 of third knit zone 1134 can define inter-toe member 144 discussed above.

In some embodiments, inter-toe area 1144 can define a recess 2025 at peripheral edge 1010 of knitted component 1000. Stated differently, the increased elasticity of inter-toe area 1144 can pull peripheral edge 1010 inward to define recess 2025. In some embodiments, recess 2025 can be present when knitted component 1000 is in its unstretched or neutral position and recess 2025 can become more pronounced as knitted component 1000 is stretched in the transverse direction 1106.

Figure 10:
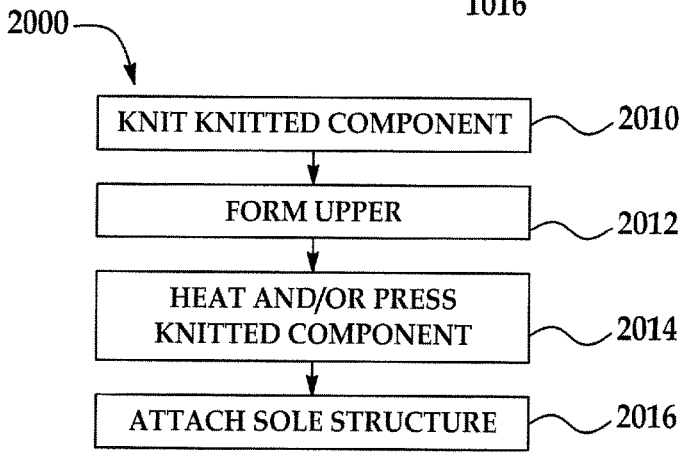
FIG. 10 is a flowchart illustrating a method of forming the article of footwear of FIG. 1 according to exemplary embodiments.

Referring now to FIGS. 10-13, a method 2000 of forming the article of footwear 100 from knitted component 1000 will be discussed according to exemplary embodiments. As shown in FIG. 10, method 2000 can begin in step 2010, in which knitted component 1000 is formed. In some embodiments, knitted component 1000 can be flat knitted to include the features discussed above and shown in FIG. 9.

Figure 11:
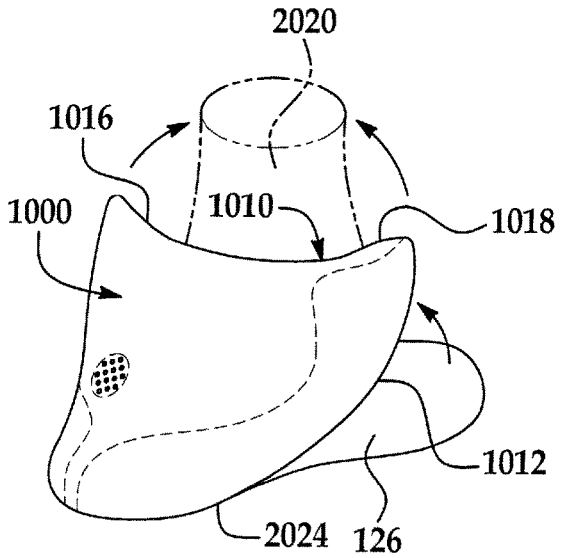
FIG. 11 is a schematic illustration of one or more steps of the method of FIG. 10.

Then, in step 2012, upper 120 can be formed using knitted component 1000. For example, as shown in FIG. 11, knitted component 1000 can be wrapped over and around a foot-shaped last 2020 and third segment 1016 and fourth segment 1018 of peripheral edge 1010 can be joined together to define a seam 2022 behind the heel of the last 2020. (The seam 2022 is shown in greater detail in FIGS. 1 and 4.) Next, underfoot part 126 can be attached to knitted component 1000. Specifically, underfoot part 126 can be attached to first segment 1012 of knitted component 1000 to define a lower seam 2024.

Figure 12:
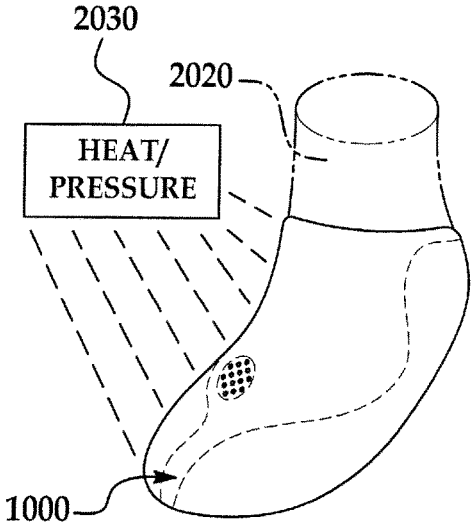
FIG. 12 is a schematic illustration of one or more steps of the method of FIG. 10.
Figure 13:
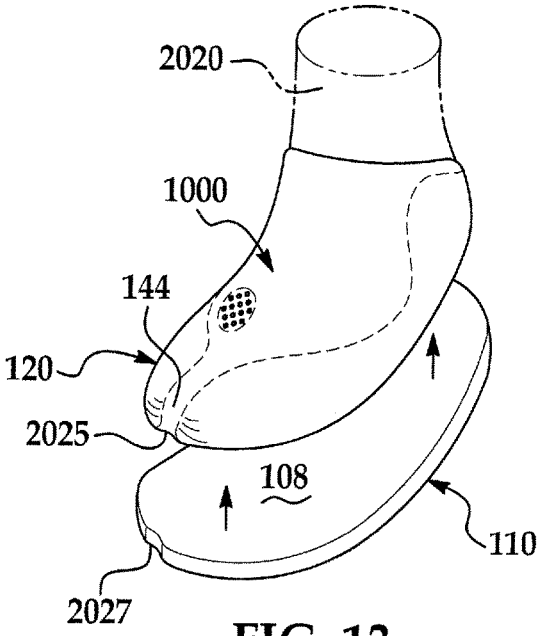
FIG. 13 is a schematic illustration of one or more steps of the method of FIG. 10.

Next, in step 2014 heat and/or pressure can be applied to knitted component 1000 from a source 2030 as shown in FIG. 12. In some embodiments, application of heat and/or pressure can slightly shrink knitted component 1000 against last 2020. This heat and/or pressure can shape knitted component 1000 such that knitted component 1000 appears more contoured and conformed to the surface of last 2020. To illustrate this effect, FIG. 13 shows knitted component 1000 after heat/pressure has been applied. As shown, the curvature of inter-toe member 144 and recess 2024 is shown more pronounced than in FIGS. 11 and 12.

In some embodiments, source 2030 can apply steam to knitted component 1000. In other embodiments, source 2030 can apply a dry heat to knitted component 1000. In still additional embodiments, a source 2030 can include a press that applies pressure for shaping knitted component 1000.

Additionally, source 2030 can be used for attaching a skin, tag, decal, or other objects to knitted component 1000.

The method 2000 of assembly can continue in step 2016, wherein the sole structure 110 is attached. This step is illustrated schematically in FIG. 13. As shown, sole structure 110 and upper 120 can be moved toward each other. Then, sole structure 110 can be attached or lasted to upper 120. It is noted that recess 2027 of sole structure 110 can be aligned with recess 2025 of knitted component 1000 and then attached. As such, recess 2027 of sole structure 110 and recess 2025 of knitted component 1000 can both flex in substantially unison as the foot flexes. Furthermore, recess 2027 of sole structure 110 can enable a greater degree of biasing of recess 2025 into the space 135 between the wearer's toes for engaging the foot.

In summary, the article of footwear 100 can include inter-toe member 144 that is received between the toes of the wearer's foot. This can allow upper 120 to engage the foot and toe area of the foot. Additionally, inter-toe member 144 can be associated with a relatively elastic portion of the upper 120. As such, inter-toe member 144 can bias other portions of upper 120 toward each other and conform portions of upper 120 to the toes and foot. Accordingly, upper 120 can provide a high degree of comfort and support to the foot of the wearer.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims. Moreover, as used in the claims "any of" when referencing the previous claims is intended to mean (i) any one claim, or (ii) any combination of two or more claims referenced.

What is claimed is:

1. An article of footwear, the article of footwear comprising:

an upper comprising a forefoot region, a midfoot region, and a heel region;

the upper comprising a first zone, a second zone, and a third zone, each of the first, second, and third zones extending from a terminal toe edge of the upper and toward the heel region;

the first zone extending laterally from a medial side edge of the upper to a first internal boundary of the upper;

the second zone extending laterally from a lateral side edge of the upper to a second internal boundary of the upper;

the third zone extending in-between the first internal boundary and the second internal boundary and entirely separating the first zone from the second zone in at least the forefoot region;

the third zone defining an indentation, the indentation extending from the terminal toe edge of the upper toward the heel region;

the first zone having a first elasticity, the second zone having a second elasticity, and the third zone having a third elasticity, wherein the third elasticity is greater than the first elasticity and the second elasticity;

and wherein the difference in elasticity between the first, second, and third zones forms the indentation.

2. The article of footwear of claim 1, wherein the third zone is biased toward the heel region.

3. The article of footwear of claim 1, wherein the third zone and the first zone cooperate to define a first portion of a toe cavity that is configured to receive at least one of a plurality of toes; the toe cavity defined by an inner surface of the upper; wherein at least a portion of the inner surface is configured to nest against the at least one of the plurality of toes.

4. The article of footwear of claim 3, wherein the at least one toe of the plurality of toes is a hallux of a foot; wherein the third zone and the second zone cooperate to define a second portion of the toe cavity that is configured to receive a second toe of the foot; and wherein the third zone is configured to be received in the space located between the hallux and the second toe.

5. The article of footwear of claim 1, wherein the upper includes a knitted component formed of unitary knit construction; and wherein the knitted component defines the third zone.

6. The article of footwear of claim 5, wherein the knitted component defines at least one of an inner surface of the upper and an outer surface of the upper.

7. The article of footwear of claim 1, wherein the upper includes a knitted component and wherein the knitted component defines the first zone, the second zone, and the third zone; and wherein the first zone, the second zone, and the third zone are formed of unitary knit construction with each other.

8. The article of footwear of claim 1, wherein the third zone is knitted from an elastic yarn; wherein at least one of the first zone and the second zone is knitted from an additional yarn; and wherein the elastic yarn has greater elasticity than the additional yarn.

9. The article of footwear of claim 1, further comprising a sole structure, wherein the sole structure includes an attachment area that attaches to the upper; wherein the third zone includes a front portion and a lofted portion, wherein the front portion extends from the attachment area away from the sole structure, wherein the lofted portion extends from the front portion generally toward the heel region; and wherein the front portion and the lofted portion are configured to be received within the space formed between two of a plurality of toes.

10. The article of footwear of claim 1, further comprising a sole structure, wherein the sole structure includes an attachment area that attaches to the upper; wherein the upper includes a collar with a collar opening configured to allow passage of a foot into and out of the upper; wherein the upper includes a throat that is disposed between the first internal boundary to the second internal boundary of the upper; and wherein the third zone extends from the attachment area of the sole structure, along the throat, toward the collar.

11. The article of footwear of claim 10, wherein the third zone extends along the throat to the collar, and wherein the third zone extends continuously around the collar opening.

12. The article of footwear of claim 1, wherein the first elasticity is equal to the second elasticity.

* * * * *